US005947139A

United States Patent [19]

Lebrecht

[11] Patent Number: 5,947,139

[45] Date of Patent: Sep. 7, 1999

[54] SHADE STAND WITH SWIRLING TYPE CANOPY

[76] Inventor: Horst Lebrecht, 16339 W. Windcrest Dr., Surprise, Ariz. 85374

[21] Appl. No.: 09/185,740

[22] Filed: Nov. 4, 1998

Related U.S. Application Data

[60] Provisional application No. 60/099,371, Sep. 8, 1998.

[51] Int. Cl.[6] ..... E04H 15/26; E04H 15/48; A45B 11/00

[52] U.S. Cl. ..... 135/20.1; 135/26; 135/31; 135/99; 135/132; 135/147; 135/152; 40/607

[58] Field of Search ..... 135/98, 99, 20.1, 135/25.1, 26, 143, 147, 31, 19, 16, 132, 133, 152, 151, 900, 901, 95; 40/606, 607, 612

[56] References Cited

U.S. PATENT DOCUMENTS 641,946 1/1900 McFarland ..... 135/152 X
1,018,522 2/1912 Savage .
3,252,469 5/1966 Peake .
4,202,121 5/1980 Maris et al. ..... 40/606 X
4,433,699 2/1984 Schultes et al. .
4,836,231 6/1989 Peterson .
4,836,232 6/1989 De Rosa et al. .
5,161,561 11/1992 Jamieson ..... 135/16
5,295,500 3/1994 Leu ..... 135/95 X
5,441,067 8/1995 James et al. .
5,579,797 12/1996 Rogers .
5,613,799 3/1997 Guide ..... 40/612 X
5,727,583 3/1998 Kennedy .

*Primary Examiner*—Christopher T. Kent
*Assistant Examiner*—Brian E. Glessner
*Attorney, Agent, or Firm*—Richard C. Litman

[57] ABSTRACT

A swirling type fabric canopy is affixed on an upright mast which can be incrementally rotated on a base to protect a person in one position while the sun travels during daylight. The swirling type canopy can be rotated from right-handed shading to left-handed shading and collapsed when not in use or for portage. An optional semi-circular non-folding canopy can be added on top.

6 Claims, 2 Drawing Sheets

SHADE STAND WITH SWIRLING TYPE CANOPY

CROSS-REFERENCE TO RELATED APPLICATION

This application claims the benefit of U.S. Provisional Patent Application Ser. No. 60/099,371, filed Sep. 8, 1998.

BACKGROUND OF THE INVENTION

1. Field of the Invention

The present invention relates generally to sun shade stands and, more specifically, to a shade stand with a swirling type canopy having multiple canopy support tubes that spiral downwardly from the top of an upright tube.

2. Description of the Related Art

The related art of interest describes various sun shades, but neither teaches nor suggests the unique swirling canopy and the optional semicircular top canopy of the present invention. The related art will be discussed in the order of perceived relevance to the present invention.

U.S. Pat. No. 3,252,469 issued on May 24, 1966, to George H. Peake describes a collapsible hyperbolic paraboloid umbrella consisting of four equal lengths of frame members having articulated coupling means at the corners. The frame members have struts connecting their midpoints to a collar with pivot wings on a mast. The struts also have connecting braces from their midpoints to the tip of the mast with similar pivot wings. A second embodiment (FIG. 7) pitches one side up and the opposite side down by using lockable sleeves on the struts. Other embodiments employ corner struts (FIG. 8) and a single center strut (FIG. 8). The collapsible hyperbolic paraboloid umbrellas are distinguishable for lacking any suggestion for a swirling type umbrella configuration.

U.S. Pat. No. 4,836,232 issued on Jun. 6, 1989, to R. James De Rosa et al. describes a fold-up umbrella wherein cloth, canvass or plastic panels are supported in a fan-like horizontal fashion by ribs mounted on a telescoping standard. The umbrella is folded like a fan with straps provided on two ends for wrapping the folded umbrella. The bottom of the standard is tapered for mounting in sand and the like. The fold-up umbrella is distinguishable for its fan-like folding and opening construction.

U.S. Pat. No. 4,836,231 issued on Jun. 6, 1989, to William R. Peterson describes a portable, collapsible fan-shaped beach shade. A telescopic pole has a pole cap at its upper end to support the shade having an opening in the center and a gap between ribs reinforced with two stabilizing bands- The bottom end has a spear shaped ground spike for placement in the sand. The beach shade is distinguishable for its fan-like construction and required stabilizing bands.

U.S. Pat. No. 4,433,699 issued on Feb. 28, 1984, to Tilmann Schultes et al. describes a sunshade suitable for positioning in a balcony with a fan-like shade supported by five struts of which the outer two and center struts have two spreading struts and an opening bar. Clamps on the center strut and the main vertical tube secure the shade in an inclined position. The sunshade is distinguishable for its limited inclining positions and use in a balcony.

U.S. Pat. No. 1,018,522 issued on Feb. 27, 1912, to George Savage describes a rectangular sun and rain protector made of a waterproof fabric supported by two end bars and a crossbar which pivots in a vertical plane on a telescopic upright stake secured in the ground. The sun and rain protector is distinguishable for its limitation for inclining a planar canopy in a vertical plane.

U.S. Pat. No. 5,579,797 issued on Dec. 3, 1996, to Allen E. Rogers describes a foldable canopy support having two or four square canopy segments for use on a boat, a bench or free-standing. The corners of the tubular frame are hinged for folding. Similarly, the side leg members have bi-folding hinges. The canopy is supported perpendicularly from a vertical mast which can have clamps or rollers at its bottom end. The canopy support is distinguishable for its reliance on a planar canopy and a folding aspect.

U.S. Pat. No. 5,441,067 issued on Aug. 15, 1995, to Peter James et al. describes a rectangular sun shade for attachment to outdoor furniture by a clamp or inserted in the ground with the clamp. The sun shade can be inclined on the upright arm. The sun shade is distinguishable for its planar configuration.

U.S. Pat. No. 5,727,583 issued on Mar. 17, 1998, to Phillip D. Kennedy describes a service umbrella with a magnetic base for mounting on a metal object for shade while working outdoors. The circular magnetic base has a pair of semicircular pin support members which support an adjustable arm support attached to a two-section umbrella pole with an intermediate gooseneck fitting to support an umbrella. The service umbrella is distinguishable for its reliance on a conventional umbrella for a canopy.

None of the above inventions and patents, taken either singly or in combination, is seen to describe the instant invention as claimed because there is neither a teaching nor a suggestion to utilize a foldable swirling type canopy with or without a top canopy.

SUMMARY OF THE INVENTION

The present invention is directed to a shade stand with a swirling type canopy having a plurality of canopy support tubes or rods that spiral downwardly from the top of an upright tube. Each canopy support tube or rod is attached to a collar. Bolt holes in only the top and bottom collars are aligned with holes at the top and midway in the upright support tube, and bolts are passer through the bolt holes to secure the canopy support tubes or rods to the upright round tube. A mounting tube of lesser diameter is permanently attached to the base and extends upwards into the upright round tube which has a clamping knob which prevents the upright tube from rotating.

The swirling type canopy can be rotated and affixed either in a left-handed or a right-handed position by rotating the uppermost collar. Also, the swirling type canopy can be incrementally positioned about the mounting tube by just rotating the upright tube and securing its position with the clamping knob. Thus, the canopy can be rotated to provide shade without the person moving his/her chair or cot.

The swirling type canopy is made of fabric such as canvas, doubled, and is arcuately rectangular in shape with a bottom portion freely suspended. A semicircular removable canopy can be optionally added to the top of the apparatus. The collars can be loosened to fold the main swirling type canopy for portage, storage or when shade is not needed.

Accordingly, it is a principal object of the invention to provide a shade stand with a swirling type canopy.

It is an object of the invention to provide a shade stand with a swirling type canopy which can be incrementally positioned about the mounting tube by just rotating the upright tube and securing its position with a clamping knob.

It is another object of the invention to provide a shade stand with a swirling type canopy with an optional removable semicircular top canopy.

It is a further object of the invention to provide a shade stand with a swirling type canopy which is foldable.

Still another object of the invention is to provide a shade stand with a swirling type canopy with a weighted base.

Yet another object of the invention is to provide a shade stand with a swirling type canopy which can be rotated to form either a right-handed or left-handed configuration.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
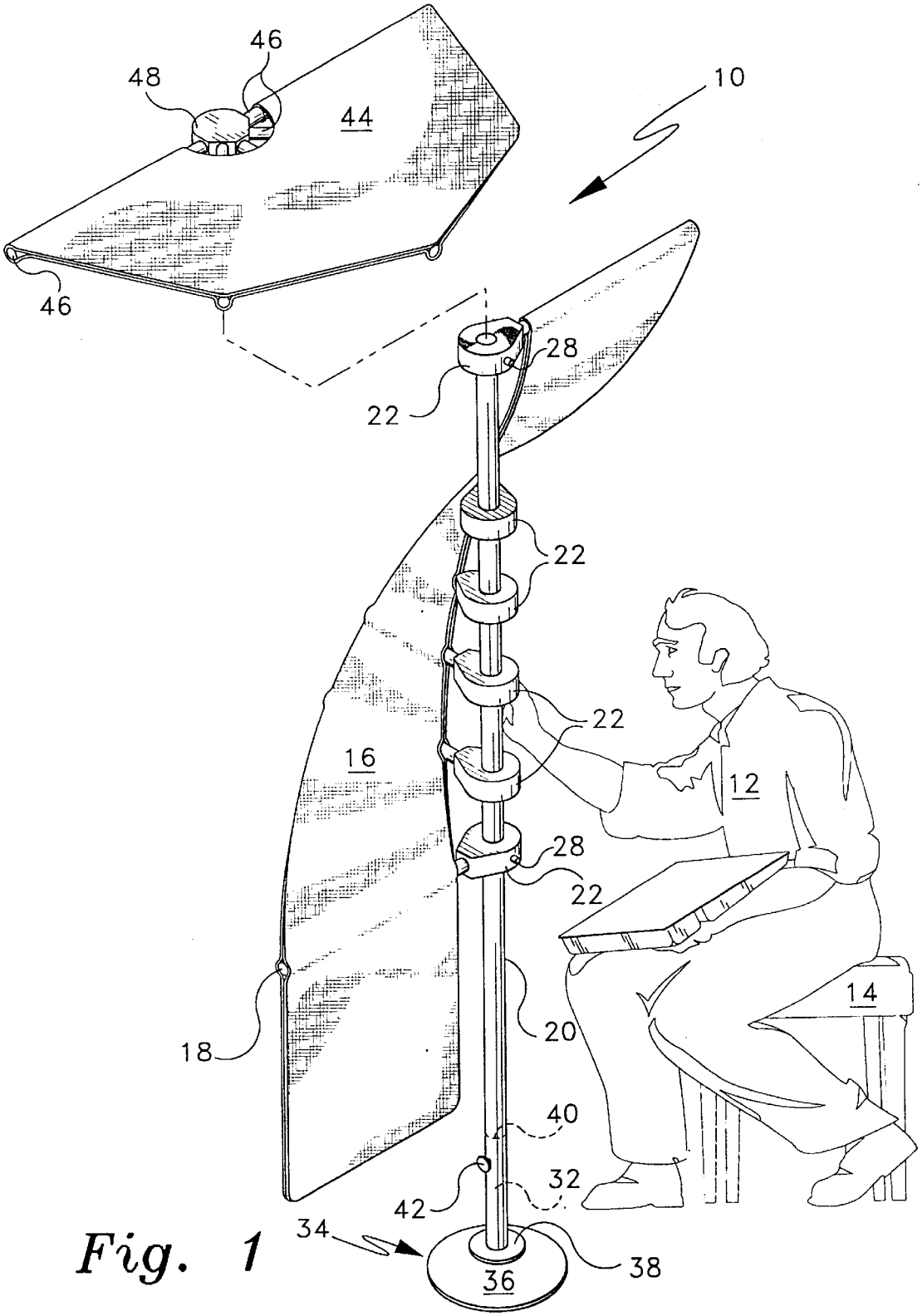
FIG. 1 is an environmental, elevational and exploded side view of a first embodiment and an alternative addition of a top canopy to a shade stand with a swirling type canopy according to thus present invention.

FIG. 1 illustrates a shade stand 10 shading a person 12 performing a task while seated in a chair 14. The person 12 can also be prone on a cot (not shown). The shade stand 10 has a swirling type canopy 16 having a plurality of canopy support rods or tubes 18 of equal length that spiral downwardly 120° or greater from the top of an upright cylindrical aluminum tube or mast 20. The swirling type canopy 16 is made of a fabric such as canvas, doubled (FIG. 3) and is arcuately rectangular in shape with a bottom portion freely suspended. It is also contemplated that the canopy 16 can be a single sheet of canvas with reinforcement strips for accomodating the canopy support tubes or rods 18.

Each canopy support rod or tube 18 is attached to a teakwood collar 22 (FIG. 2) and extended perpendicularly to the upright tube 20. Pin holes or throughbores 24 in only the uppermost and lowermost collars 22 are aligned with throughbores 26 (hidden) in the upright support tube 20, and smooth brass pins 28 (having a shoulder 30 and a head 31) are passed through the mast throughbores 26 to secure the canopy support rods or tubes 18 to the upright cylindrical tube or mast 20. The intermediate collars 22 lack fastening means and are free to slide up and down the upright mast 20 as well as to rotate.

A metal mounting tube 32 (hidden shadow) is permanently attached to a heavy base 34 such as concrete with sloping sides 36 and extends upwards into the upright round tube or mast 20 to the shadow line 40. There is also a brass washer 38 that is slipped over the mounting tube 32 and rests on the base 34 and facilitates the rotation of the upright tube or mast 20. The canopy 16 can be incrementally positioned about the mounting tube 32 by just rotating the canopy 16 and securing its position with the clamping knob 42 to shade the person 12 as the sun moves. Thus, the swirling type canopy 16 can be rotated to provide shade without the person 12 moving his/her chair 14 or cot.

A semicircular removable canopy 44 can be optionally added to the top of the shade stand 10 to further shade the user. The canopy 44 consists of a plurality of canopy support tubes or rods 46 held horizontally by a teakwood base 48 on a solid or tubular post 49 which is secured at the top of the upright tube or mast 20 by a brass fastener 50 in a pair of mounting throughbores 52 shown in FIG. 3. The throughbores 52 accommodate the positioning of the canopy 44 in either the right- or left-hand position on the upright tube or mast 20. The throughbores 52 also accommodate the positioning of the swirling type canopy 16 in either the right- or left-handed position on the upright tube 20 when the uppermost collar 22 is rotated and affixed with the collar pin 28.

Figures 2, 3:
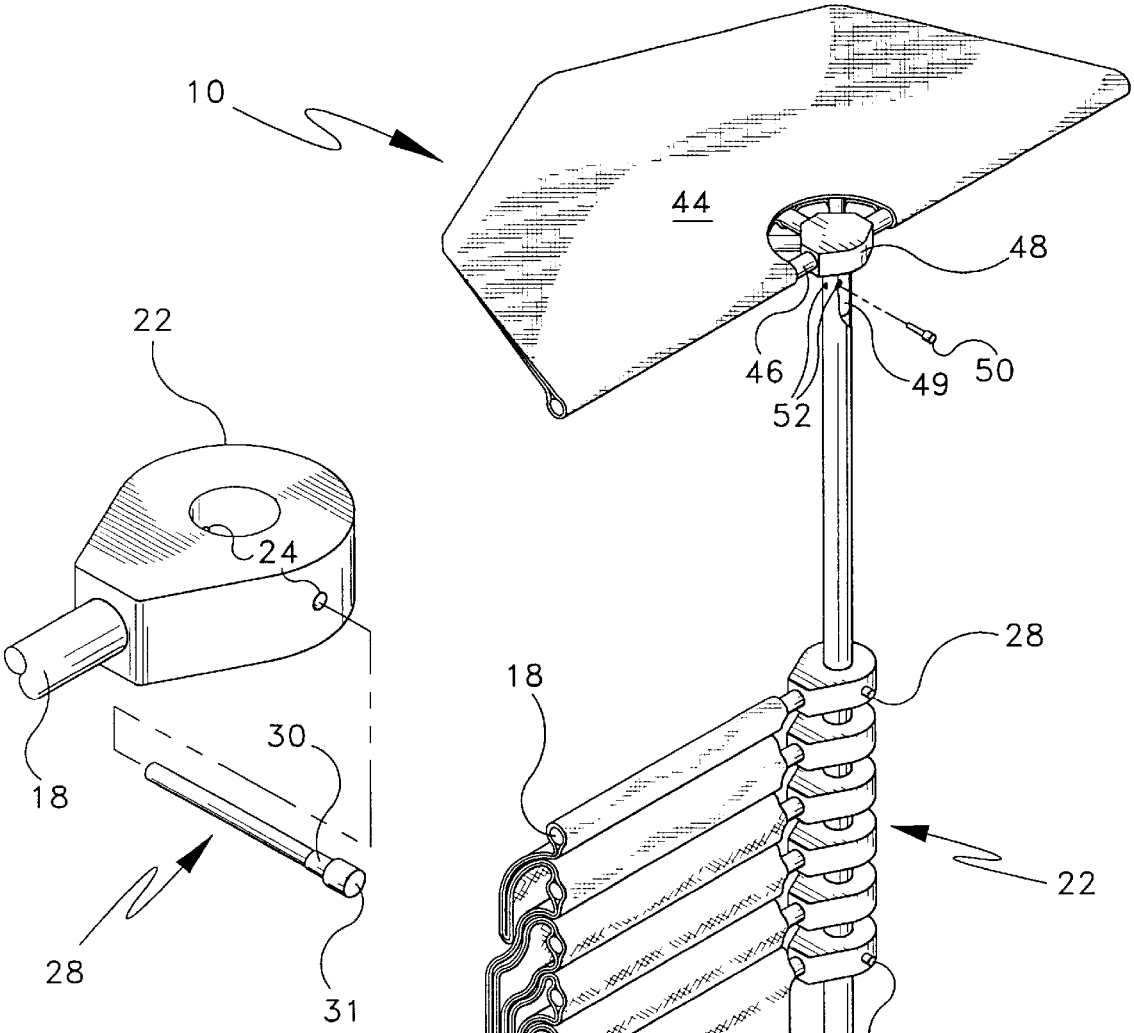
FIG. 2 is a partial perspective view of a collar, support rod or tube and a fastening pin.
FIG. 3 is a perspective view of the FIG. 1 shade stand with the swirling type canopy folded.

In FIG. 3, the collars 22 are shown loosened to fold the main swirling type canopy 16 for portage, storage or when shade is not needed.

Exemplary dimensions of the various parts of the swirling type canopy are as follows.

upright tube 20: 6 to 7 ft. long, 1.9 in. O.D., aluminum.

washer 38: 3 in. O.D., brass.

mounting tube 32: 12 in. long, 1.66 in. O.D., aluminum.

collars 22: 5 in. long, 2 in. outer radius in the ring portion and 3 in. in the necked portion, 1.9 in. diameter center hole; and 1.7 in. deep, 1 in. diameter bore in the neck portion for dowel support 18, teakwood with a protective finish.

canopy support rods or tubes 18: 3 ft. long, 1 in. diameter, birch wood dowels or metal tubes, e.g., aluminum, with an outdoor protective finish.

collar pin 28: 4.75 in. long, 5/16 in. diameter body, 0.5 in. diameter head, brass.

swirling type canopy 16: 5–6 ft. long, 3 ft. wide, arcuately configured rectangular canvas.

base 48: 2 ft. diameter, sloped upper surface, concrete.

top canopy 44: 6 ft. diameter, semicircular, canvas cover.

Clamping knob 42: plastic knob with a threaded stem.

It is to be understood that the present invention is not limited to the sole embodiment described above, but encompasses any and all embodiments within the scope of the following claims.

I claim:

1. A foldable shade stand with a swirling type canopy comprising:

an upright cylindrical tube;

a plurality of canopy support rods;

collars connected to said support rods at one end and positioned at intervals from the top of said upright tube to a position above the bottom of said upright tube;

a fabric arcuately rectangular in shape and attached to each said canopy support rod to form a swirling type canopy having a partial spiral configuration with a portion suspended from the bottommost canopy support rod;

a cylindrical upright mounting tube having a diameter less than the diameter of said upright cylindrical tube for insertion within said upright tube and having a clamping knob for incremental positioning of said upright tube and the appended canopy; and a heavy base with sloping sides supporting said mounting tube; whereby the swirling type canopy can be rotated incrementally to shade a person resting in one position while the sun is moving during the day.

2. The foldable shade stand according to claim 1, including a separate semicircular top canopy horizontally positioned on said upright cylindrical tube.

3. The foldable shade stand according to claim 1, wherein the swirling type canopy is rotationally mountable so as to have, selectively, a left-handed or a right-handed position about said upright cylindrical tube which has separate mounting throughbores at its top end.

4. The foldable shade stand according to claim 1, wherein only the uppermost and lowermost collars have attachment pins which traverse the upright cylindrical tube for lock-positioning the swirling type canopy, there being through apertures in said tube for accepting said attachment pins.

5. The foldable shade stand according to claim 4, said canopy being dimensioned and configured so that, upon the uppermost collar being unpinned from said tube, the swirling type canopy may be folded down to the lowermost collar.

6. The foldable shade stand according to claim 1, further comprising a separate, additional, substantially semicircular canopy mounted atop said upright, cylindrical tube.

* * * * *